United States Patent [19]

Demny

[11] 4,391,117

[45] Jul. 5, 1983

[54] ROLLING MILLS AND METHODS OF ROLLING

[75] Inventor: Werner Demny, Düsseldorf, Fed. Rep. of Germany

[73] Assignee: Friedrich Kocks GmbH & Company, Ilden, Fed. Rep. of Germany

[21] Appl. No.: 300,325

[22] Filed: Sep. 8, 1981

Related U.S. Application Data

[63] Continuation of Ser. No. 42,812, May 29, 1979, abandoned.

[30] Foreign Application Priority Data

Jun. 2, 1978 [DE] Fed. Rep. of Germany ..... 2824143

[51] Int. Cl.[3] ..... B21B 13/22; B21B 1/46

[52] U.S. Cl. ..... 72/224; 72/234; 72/366; 29/527.7

[58] Field of Search ..... 72/199, 224, 234, 366; 29/527.7

[56] References Cited

U.S. PATENT DOCUMENTS 3,729,973 5/1973 Wykes ..... 72/234
3,837,207 9/1974 Tarmann ..... 72/366
4,044,586 8/1977 Properzi ..... 72/224
4,070,893 1/1978 Nishikubo et al. ..... 72/234

FOREIGN PATENT DOCUMENTS 2126177 12/1972 Fed. Rep. of Germany ..... 72/234

*Primary Examiner*—Lowell A. Larson
*Assistant Examiner*—Jonathan L. Scherer
*Attorney, Agent, or Firm*—Buell, Blenko, Ziesenheim & Beck

[57] ABSTRACT

A rolling mill and method for rolling material having a rectangular, oval or like elongated cross-sectional configuration into rod or wire, has a line of passes of which the first pass is formed by two rollers and the remaining passes are each formed by three rollers, and wherein the first pass deforms the material, whose input cross section has a ratio of the lengths of its major and minor principal axes greater than about 1:2 to an output cross section which is exactly round or a regular polygon, such as square or hexagonal or which deviates from such a geometrical configuration only to an extent such that the ratio of the lengths of the major and minor principal axes of the output cross section does not exceed about 1:2.

13 Claims, 5 Drawing Figures

ROLLING MILLS AND METHODS OF ROLLING

This application is a continuation of application Ser. No. 42,812, filed May 29, 1979, now abandoned.

This invention relates to rolling mills and methods of rolling and particularly to a rolling mill for the rolling of bars or wires from stock having a rectangular, oval or similarly elongate cross-sectional shape, in which the ratio of the lengths of the cross-sectional axes of symmetry, extending at right angles to one another (the major and minor principal axes) is greater than approximately 1:2.

When rolling bars or wire, one generally starts with a material having a square or round cross section. Substantially regular polygonal cross sections, such as a hexagon, can also be used satisfactorily. However, starting material having these kinds of cross sections are not always available. By way of example, when a continuous casting plant is disposed immediately beyond a rolling mill for the rolling of bars or wire, only starting material having a rectangular or similar cross-sectional shape enters the rolling mill for reasons of casting technology. Provided that the ratio of the lengths of the major and minor principal axes of the relevant cross section does not exceed a value of approximately 1:2, a material of this kind, such as a material having a rectangular cross section, can still be rolled with the known three-roller wire rolling mills, although difficulties occur during rolling when the ratio of the lengths of the major and minor principal axes is more than approximately 1:2. Owing to the differing properties of the materials, the value of 1:2 cannot, of course, be an absolute value, but only an approximate value which can vary by approximately $\pm 0.05$.

Difficulties arise above these limits when a rolling mill, whose sizing passes are formed by three rollers, is used for the rolling of wire. In rolling sizing passes of this kind, a longer side of the incoming first pass entry cross-sectional area, such as a rectangular first pass entry cross-sectional area, is always located on the working surface of one roller, and the sizing pass remains unfilled in the region of the oppositely located gap between two rollers.

Thus, the sizing pass is filled non-uniformly, which also applies in an undesirable manner to the shape of the finished product. Furthermore, in the case of large reductions in the cross section the material is deformed into the other two roller gaps where it forms web-like ribs which lead to folding over of the work material and to a large variety of rolling faults in the following sizing passes.

However, compared with a rolling mill having sizing passes formed by two rollers, a rolling mill having sizing passes formed by three rollers has considerable advantages which it is desirable to exploit. Namely, the three-roller sizing passes effect a virtually ideal deformation of the work material with only a small amount of broadening, which is equivalent to a high degree of rolling efficiency. Furthermore, the stresses occurring in the work material during deformation are particularly uniform up to the center of the cross section of the work material, so that it is possible to roll materials of greatly differing deformation characteristics with the same sizing pass, and especially to process materials having particularly poor deformation characteristics, such as high-alloyed high-grade steels, tungsten or molybdenum, in a satisfactory and economic manner and at relatively high speeds. Surface flaws caused by folding over of thin ribs do not occur even when, with the same sizing passes, the rolling program includes materials having a greatly differing broadening behavior.

An object of the invention is to provide a rolling mill for the rolling of bars or wire, in which the important, above-mentioned advantages of a rolling mill having three-roller sizing passes can be utilized, but in which, on the other hand, work material can also be processed which has a rectangular, oval or a similar elongate cross-sectional shape in which the ratio of the lengths of the major and minor principal axes is greater than approximately 1:2. The elongation mentioned here and previously does not relate to the linear expansion of the work material, but to the deformation of the cross section of the work material. This also applies to the following embodiments.

The present invention resides in a rolling mill which has a plurality of roller stands arranged closely one behind the other to define a line of sizing passes, wherein the first sizing pass at the entry end is formed by two rollers, and the following sizing passes are each formed by three rollers and wherein the cross-sectional shape of the first sizing pass is that of an exact circle or of a regular polygon having an even number of sides or is of a like but somewhat elongated geometrical figure, the ratio of the lengths of whose principal axes does not exceed approximately 1:2, one roller axis of the immediately following three-roller sizing pass extending parallel to the longer principal axis of the first sizing pass cross section, in the case wherein the latter is somewhat elongated.

Thus, the second sizing pass of the rolling mill, which is the first formed by three rollers, receives a work material cross section which can be deformed in this sizing pass and in the following three-roller sizing passes without difficulty and without rolling defects. The disadvantages mentioned initially are substantially averted, and the above-mentioned advantages of three-roller sizing passes can be utilized. The single two-roller sizing pass of the rolling mill deforms the first pass entry cross-sectional area of the work material such that the ratio of the lengths of the major and minor principal axes of the first pass exit cross section is less than approximately 1:2.

According to the kind of first pass entry cross-sectional area, the first sizing pass, formed by two rollers, can have a circular cross section, a slightly non-circular, oval, elliptical or, alternatively, polygonal cross section such as a hexagon. The only essential thing is that the cross-sectional shape of the first sizing pass should be such that the ratio of its major and minor principal axes is less than approximately 1:2. If a circular cross section is formed by the two rollers of the first sizing pass, the dimension of this cross section, compared with the first pass entry cross-sectional area, can be such that the cross section of the sizing pass is not completely filled and flattened regions are produced laterally on the work material in the region of the roller gap. These flattened or slightly curved sides can be obtained by, for example, grinding a large arc into the rollers or by corresponding adjustment of the rollers with simultaneous enlargement of the roller gap. It will be appreciated that, alternatively, the round can be completely filled. However, the sizing pass shape which produces a work material cross section with flattened sides has the additional advantage that fluctuations in the first pass entry cross-sectional area cannot lead to over-filling of the first sizing pass and thus to the extrusion of material into the roller gap. The radius ground into the two-roller sizing pass can then be larger, equal to or smaller than half the dimension between the bottoms of the roller grooves forming the sizing pass. The reduction depends upon the ratio of the sides of the incoming cross section, such as a rectangular cross section, and the broadening behavior of the material. The reduction can lie between 15 and 25%.

In a preferred embodiment of the invention, the major principal axis of the first pass entry cross-sectional area entering the first sizing pass extends vertically, and the roller axes of the first sizing pass extend horizontally. Furthermore, it is advantageous when a roller axis of the second sizing pass is arranged vertically. Advantageously, the other sizing passes, which are formed by three rollers and which follow the second sizing pass, should have a roller axis which extends vertically. An arrangement of this kind results in a favorable structural solution for the drive for the rolling mill and at the same time offers the possibility of satisfactory deformation for the purposes of the present invention.

In a further development of the invention, the sizing pass opening has, in the region of the roller gap of the first sizing pass, widened portions whose boundary lines slope relative to the roller axes. By way of example, the boundary lines of the widened portions extend tangentially in the case of circular sizing pass cross sections, and this can also apply in the case of oval or elliptical cross-section shapes. This construction of the first sizing pass considerably improves the grip conditions of the same i.e., the efficiency by which the rollers grip the work material, this being of importance particularly in the case of large reductions and when cold-rolling.

In the foregoing general description of my invention I have set out certain objects, purposes and advantages of my invention. Other objects, purposes and advantages of this invention will be apparent from a consideration of the following description and the accompanying drawings in which.

Figure 1:
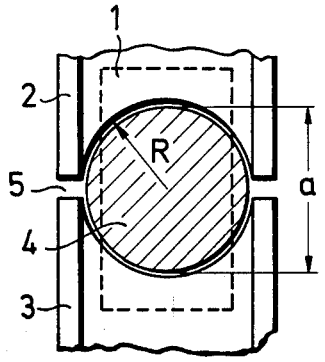
FIG. 1 shows a rolling mill first sizing pass having a circular cross section.

Referring to FIG. 1, I have illustrated in broken line a bar or rod having a rectangular first pass entry cross-sectional area 1, the ratio of the lengths of whose major and minor principal axes exceeds approximately 1:2, entering the first sizing pass of a rolling mill with the major principal axis of the entry cross-sectional area extending vertically. The first sizing pass is formed by two rollers 2 and 3 only parts of which are illustrated and whose axes are horizontal. The subsequent passes of the rolling mill are conventional three-roller passes. In FIG. 1, the first sizing pass cross section is circular and is completely filled with the material 4. Thus, the second sizing pass (not illustrated in FIG. 1) formed by three rollers receives the material having a circular cross section which does not cause any difficulties during the subsequent rolling operation. The sizing pass to which the rollers 2 and 3 are machined, has a radius R which corresponds exactly to half the dimension a measured between the bottoms of the grooves machined in the rollers. However, if the first pass entry cross-sectional area 1 is enlarged as a result of non-uniformity of the incoming material, the sizing pass in the embodiment of FIG. 1 can be very easily over-filled and thus the material can be extruded into the roller gaps 5.

Figure 2:
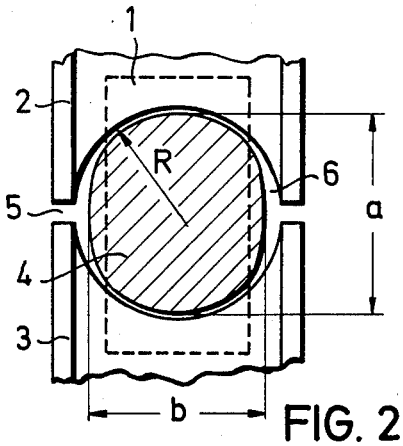
FIGS. 2 and 3 show rolling mill first sizing passes with elongate although generally circular or rounded cross sections.

In the embodiment of FIG. 2, the sizing pass radius R is greater than half of the dimension a measured between the bottoms of the roller grooves, so that unfilled portions 6 are produced laterally in the region of the roller gaps 5 and reliably prevent over-filling of the sizing pass. In the event of an unintentional increase in the first pass entry cross-sectional area 1, the material can deform into the portions 6 without the material entering the roller gaps 5. The ratio of the dimension a between the bottoms of the roller grooves to the width b of the sizing pass exit cross section can be up to 1:2.

Figure 3:
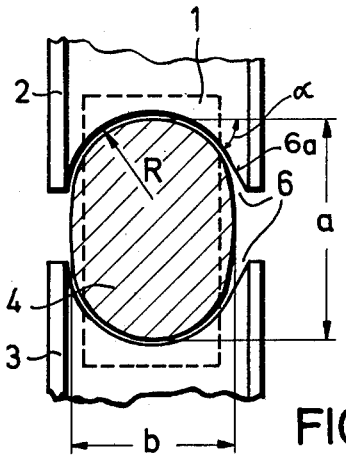

Referring to FIG. 3, the sizing pass is elongated to an even greater extent than in FIG. 2, the radius R of the sizing pass being considerably smaller than half the dimension a between the bottoms of the roller grooves, so that a sizing pass of oval shape is produced. While the left-hand side of FIG. 3 shows the embodiment in which a widened portion 6 has been omitted, the right-hand side of FIG. 3 shows an embodiment in which a widened portion 6 has been produced by means of a tangentially extending boundary line 6*a*, wherein the boundary line 6*a* slopes at an angle $\alpha$ relative to the roller axes (not illustrated).

In the embodiments of FIGS. 2 and 3, wherein the sizing passes are of somewhat elongated configuration, one roller axis of the immediately following three-roller stand (not shown) is parallel to the major principal axis, i.e., is also vertical.

Figure 4:
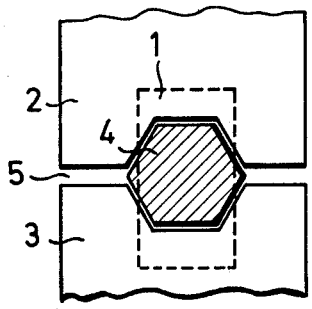
FIGS. 4 and 5 show rolling mill first sizing passes having hexagonal cross sections.
Figure 5:
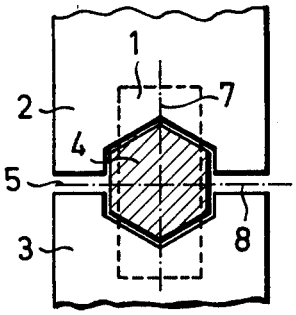

FIGS. 4 and 5 show that it is also possible for the first sizing pass, formed by two rollers 2 and 3, to be of hexagonal configuration. The rectangular first pass entry cross-sectional area 1 is deformed at the first sizing pass to form a hexagon which, of course, can be satisfactorily rolled in the following three-roller sizing pass or sizing passes.

The cross sections of the sizing passes in all the Figures can be elongated by varying the adjustment of the rollers and thus with the varying of the size of the roller gap, which would facilitate the entry of the rectangular first pass entry cross-sectional area 1. However, the cross section of the sizing pass must not be elongated to an extent where the ratio of the lengths of the major and minor principal axes of the cross section, designated 7 and 8 respectively in FIG. 5, is greater than 1:2.

In the foregoing specification I have set out certain presently preferred embodiments and practices of my invention, however, it will be understood that this invention may be otherwise embodied within the scope of the following claims.

I claim:

1. A rolling mill for rolling of bars and wire from stock having a rectangular, oval or similar elongate cross-sectional shape, the ratio of the lengths of the principal axes of the cross section of said stock being larger than approximately 1:2, comprising a plurality of roll stands arranged closely one behind the other to define a line of sizing passes, said roll stands having (a) a first entry sizing pass stand formed by two rolls whose roll axis is substantially transverse to the principal axis of the stock being rolled and receiving the stock to be rolled, (b) the cross-sectional shape of the said first sizing pass being one of an exact circle, a regular polygon having an even number of sides and a like but somewhat elongated geometrical figure, (c) the ratio of the lengths of whose principal axes does not exceed approximately 1:2, and (d) at least one three roll stand immediately following said two roll stand receiving the rolled stock from said first stand, the first stand of said three roll stands adjacent the two roll stand having one roll axis extending parallel to the longer principal axis of the first sizing pass cross section, in the case wherein the latter is somewhat elongated, all roll stands following the first stand being three roll stands.

2. A rolling mill as claimed in claim 1, in which the major principal axis of the first pass entry cross-sectional area of the stock to be rolled upstream of the first sizing pass extends vertically, and the roller axes of the first sizing pass extend horizontally.

3. A rolling mill as claimed in claim 1 or 2, in which one roller axis of three rollers of the second sizing pass is arranged vertically.

4. A rolling mill as claimed in claim 1 or 2, in which the sizing pass opening has, in the region of the roller gap of the first sizing pass, widened portions whose boundary lines slope relative to the roller axes.

5. A rolling mill as claimed in claim 3 in which the sizing pass opening has, in the region of the roller gap of the first sizing pass, widened portions whose boundary lines slope relative to the roller axes.

6. A rolling mill as claimed in claim 1 or 2, wherein the cross-sectional shape of the first sizing pass is a circle.

7. A rolling mill as claimed in claim 1 or 2, wherein the cross-sectional shape of the first sizing pass is elliptical with the major axis transverse to the roller axes.

8. A rolling mill as claimed in claim 1 or 2, wherein the cross-sectional shape of the first sizing pass is hexagonal.

9. A method of rolling bars and wire from stock having a rectangular, oval or similar elongate cross-sectional shape, the ratio of the lengths of the principal axes of the cross section of said stock being larger than about 1:2, comprising the steps of:

(a) passing said stock between two rolls forming a first roll pass opening having a cross-sectional shape in one of an exact circle, a regular polygon having an even number of sides and a like elongate geometric figure having principal cross-sectional axes whose ratio is less than 1:2, and whose roll axes are substantially transverse to the principal axis of the stock being rolled; and (b) thereafter passing the sized product successively through at least one additional roll pass formed by three rolls, said roll pass immediately following the two roll pass having one roll axis extending parallel to the longer principal axis of said first roll pass section in the case where said section is elongate, and all passes thereafter being three roll passes.

10. The method as claimed in claim 9 wherein one roller axis of said at least one additional roll pass extends parallel to the longer principal axis of the first pass cross section.

11. The method as claimed in claims 9 or 10, wherein the first roll pass opening is a circle.

12. The method as claimed in claims 9 or 10, wherein the first roll pass opening is elliptical.

13. The method as claimed in claims 9 or 10, wherein the first roll pass opening is a hexagon.

* * * * *

UNITED STATES PATENT AND TRADEMARK OFFICE

CERTIFICATE OF CORRECTION

PATENT NO. : 4,391,117

DATED : July 5, 1983

INVENTOR(S) : WERNER DEMNY

It is certified that error appears in the above-identified patent and that said Letters Patent is hereby corrected as shown below:

Column 3, line 66, "a" should be --a--.

Column 4, line 6, "a" should be --a--.

Column 4, line 13, "a" should be --a--.

Column 4, line 15, "b" should be --b--.

Column 4, line 19, "a" should be --a--.

Signed and Sealed this

*Fourth* Day of *October 1983*

[SEAL]

*Attest:*

GERALD J. MOSSINGHOFF

*Attesting Officer*

*Commissioner of Patents and Trademarks*